United States Patent [19]

Burns et al.

[11] 4,215,448

[45] Aug. 5, 1980

[54] PAINT APPLYING TOOL

[75] Inventors: Fredrick B. Burns, South Milwaukee; Richard J. Shaw, Brookfield, both of Wis.

[73] Assignee: E Z Paintr Corporation, Milwaukee, Wis.

[21] Appl. No.: 889,241

[22] Filed: Mar. 23, 1978

[51] Int. Cl.[2] ..... A46B 5/02

[52] U.S. Cl. ..... 15/210 R; 15/145

[58] Field of Search ..... 15/143 B, 144 A, 145, 15/146, 209 R, 210 R, 220, 244 R, 244 A; 401/196, 203, 204, 207; D4/38

[56] References Cited

U.S. PATENT DOCUMENTS

| | | | |
|---|---|---|---|
| 1,272,715 | 7/1918 | Richards | 401/204 |
| 1,375,560 | 4/1921 | Campbell | 15/145 X |
| 1,921,921 | 8/1933 | Harvie | 401/203 |
| 2,172,479 | 9/1939 | McMillen | 15/146 X |
| 2,912,711 | 11/1959 | Hilton | 15/244 R |
| 3,629,894 | 12/1971 | Stefany | 15/146 |
| 3,797,062 | 3/1974 | LoCicero et al. | 15/244 R |
| 3,994,037 | 11/1976 | Sims | 15/146 |

FOREIGN PATENT DOCUMENTS

| | | | |
|---|---|---|---|
| 2203968 | 8/1973 | Fed. Rep. of Germany | 401/207 |
| 157617 | 12/1932 | Switzerland | 15/176 |
| 1095 | of 1914 | United Kingdom | 401/196 |
| 1427149 | 2/1976 | United Kingdom | 15/210 R |

*Primary Examiner*—Philip R. Coe

*Attorney, Agent, or Firm*—Mason, Kolehmainen, Rathburn & Wyss

[57] ABSTRACT

A pad-type painting applicator of the type having a handle and a replaceable applicating pad includes a simplified design for use in either of two paint applying modes and an improved mechanism for removably mounting applicating pads. A relatively short handle gripping portion is secured to an enlarged base, which mounts the replaceable applicating pad, for use when painting areas close within reach of the painter and where the painter can easily move the tool in strokes generally parallel to the surface on which the paint is being applied. A threaded aperture or short cylindrical portion is provided in the base at an angle with respect to the handle gripping portion for use in conjunction with an elongated extension pole that may be secured to the tool to enable normally inaccessible areas or surfaces to be reached. A flexible tab on the base secures a slideably mounted applicating pad generally in the center thereof.

7 Claims, 4 Drawing Figures

PAINT APPLYING TOOL

BACKGROUND OF THE INVENTION

1. Field of the Invention

This invention relates to pad-type painting applicators, and more particularly, to an improved simplified structure of the handle and pad mounting system.

2. Brief Description of the Prior Art

Paint applying tools of this general type, which include a generally planar pad applicator are known in the prior art. For example, U.S. Pat. No. 3,473,183 to Burns et al discloses a paint applying tool of a construction wherein the handle portion includes a grippable section which is pivotally movable relative to the base. Another applicator of this general type is shown in U.S. Pat. No. 3,599,265 to D'Ercoli et al. This particular applicator provides a latch member on the handle for releasably retaining the applicator pad on the handle portion.

U.S. Pat. No. 3,605,165 to Burns discloses another pad-type paint applying tool in which guide means in the form of a pair of rollers are mounted within the housing portion to guide the user, for example, when painting abutting walls or the like.

SUMMARY OF THE INVENTION

This invention is directed, in brief, to the provision of an improved general purpose paint applying tool of the pad or planar applicating surface type.

The best mode currently contemplated for carrying out the invention includes the provision of an applicator having a generally enlarged base portion for removably securing a replaceable applicating pad. The base is connected to a handle portion which includes a short, generally hollow handle gripping portion which extends in a plane generally parallel to the plane of the surface of the applicating pad. The base or the handle portion also includes an internally threaded cylindrical portion which is adapted to receive a threaded extension pole to enable normally inaccessible areas to be reached. The replaceable pads include a pair of opposing flanges which interfit and frictionally engage opposite edges of the base and a generally centrally located flexible tab provides a detent means for aligning the pad on the base and to resist relative movement.

Figure 2:
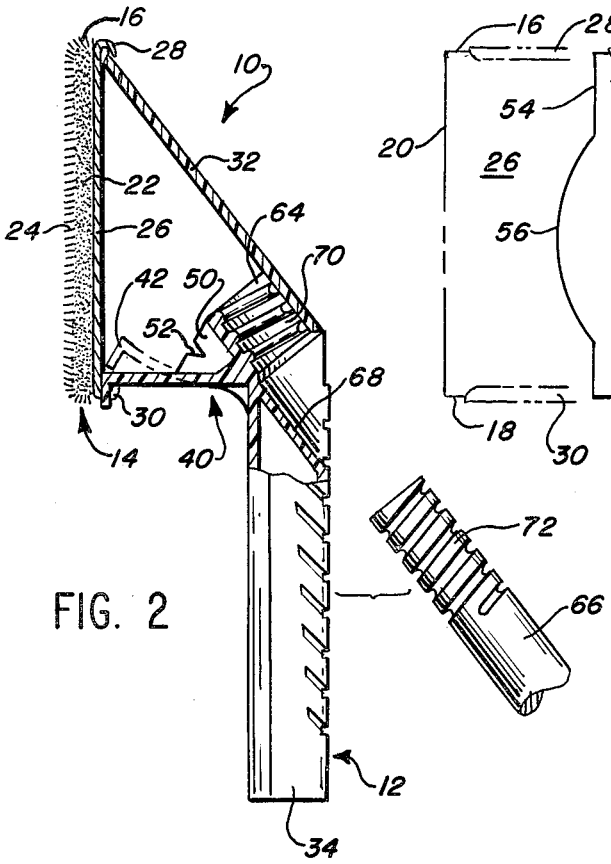
FIG. 2 is a side elevational view of the paint applicating tool of FIG. 1 shown partially in section for clarity of illustration.

While this invention is susceptible of embodiment in many different forms, there is shown in the drawings and will herein be described in detail, a specific embodiment therefore, with the understanding that the present disclosure is to be considered an exemplification of the principles of the invention and is not intended to limit the invention to the embodiment illustrated.

DESCRIPTION OF THE PREFERRED EMBODIMENT

Figure 1:
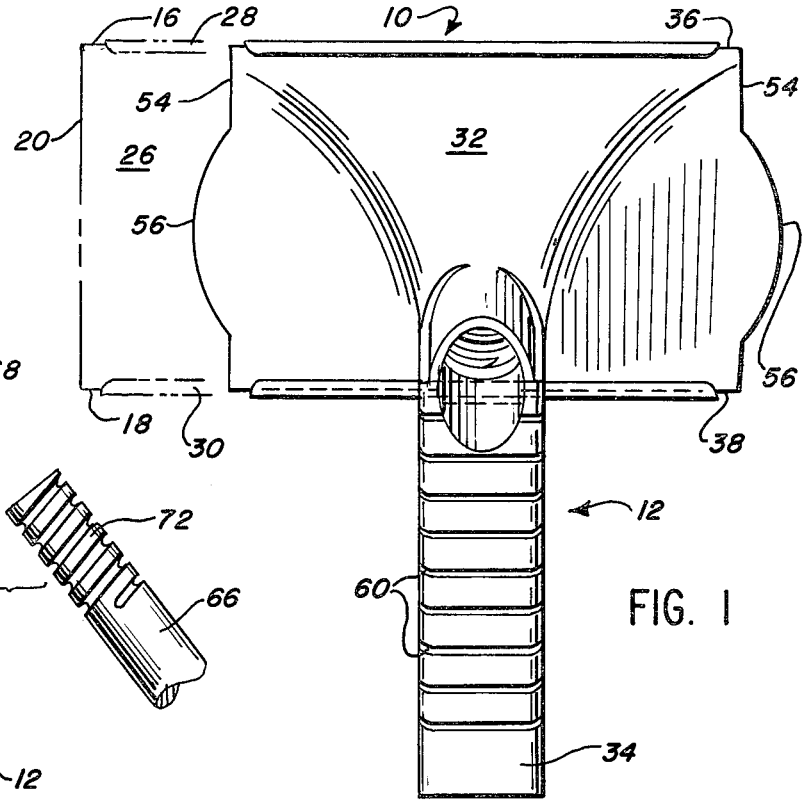
FIG. 1 is a top plan view of a paint applicating tool made in accordance with the concepts of the present invention.

A paint applying tool made in accordance with the concepts of the present invention is shown in FIGS. 1 and 2 and generally designated by the reference numeral 10. The applicator includes a handle portion, generally designated 12, and a removable applicator element 14 releasably connected thereto. Generally speaking, the applicator element has substantially parallel front and rear edges 16 and 18 and parallel side edges 20. However, neither pairs of edges must be parallel to one another, and it is often desirable that the side edges 20 converge towards each other from the front edge 16 to the rear edge 18. The applicator element 14 includes a compressible intermediate member 22, preferably of sponge-like material. This intermediate member is secured to a paint carrying or transfer member 24, on the face of the paint applying tool which includes a plurality of short erect fibers, such as mohair or the like, bonded to the forward surface of the intermediate member 22. The flexible intermediate member 22 is bonded to a rigid flat, plate-like element 26 which removably mounts the pad 14 to the handle portion 12. Preferably, the base plate 26 is formed of a non-corrosive sheet metal such as aluminum or the like. The front and rear edges 28 and 30, the sheet member 26 are bent upwardly and toward one another slightly to form a groove or channel at its opposite sides for slidably mounting on the handle member 12 as will be described in detail hereinafter.

Figure 3:
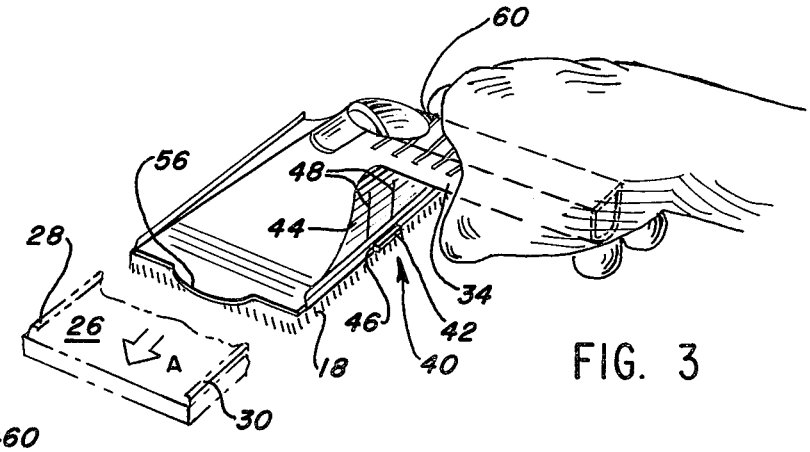
FIG. 3 is a perspective view illustrating the paint applying tool of this invention in use painting a flat surface within close reach of the user.

The handle member 12 includes two parts, a base portion 32, generally in the form of an elongated contoured pyramid shape and a hand gripping portion or element 34 secured generally to the apex of the base 32. The bottom open end of the base portion 32 includes a front edge 36 and a rear edge 38 which cooperate to mount the applicator pad to the handle 12. The front and rear edges 36 and 38 are parallel to one another and formed of sufficient thickness to slidably interfit within the flanges 28 and 30 respectfully of the applicator element 14 for easy removability and replacement by the user. The replaceable applicator element 14 is secured to the generally rectangular bottom surface of the base element 32 by detent means 40 generally at the center thereof. The detent means 40 comprise a tab 42 secured to the back, generally vertical wall 44 of the base portion 28. The tab 42 extends through a complementary shaped slot 46 formed in the rear flange 30 approximately at the center thereof. The tab 42 is movable out of engagement with the slot 46 by applying pressure to the rear wall 44 generally directly above the tab 42 to permit sliding movement of the applicating pad 14 relative to the handle portion 12 for removal in the direction of arrow A (FIG. 3). Conversely, for mounting a replacement applicator pad 14, the flanges 28 and 30 are aligned to fit over the edges 36 and 38 of the base portion 32 for sliding movement in the direction opposite arrow A. Again, the tab 42 is depressed to permit clearance therepast and released by biased movement into the slot 46.

Preferably, the handle member 12 is formed of resilient plastic or suitable material to facilitate the above described movement of the tab 42. In the preferred embodiment shown in the drawings, a pair of generally vertical slots 48 are provided in the rear wall 44 extending upwardly from the tab 42 to facilitate movement thereof. An internal strengthening rib 50 is provided on the interior of the wall 44 to provide additional biasing force to bias the tab 42 into engagement with the aperture 46. The amount of biasing force can be adjusted and is preferably lessened by the provision of a V-shaped notch 52 formed in the flange 50.

The flexible tab 42 thus maintains the removable applicating pad generally within the center of the base 32. The remaining sides 54 of the base portion 32 each include an arcuate protuberance 56 which extends past the side edges 20 of the applicating pad 14 to provide a guide surface or trim guide for painting corners, trimming against the ceiling or similar situations.

Figure 4:
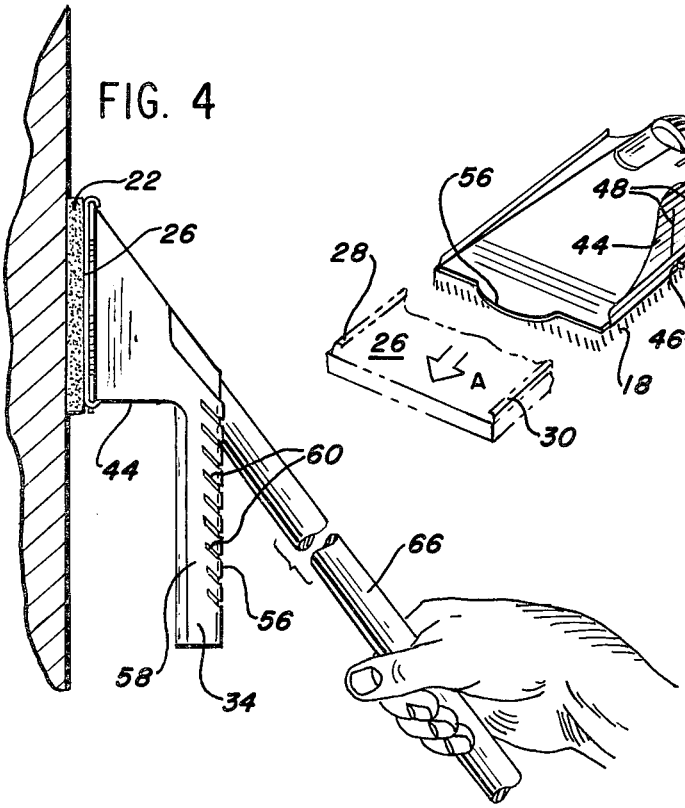
FIG. 4 is another side elevational view of the paint applying tool of this invention used in combination with an extension pole for painting normally inaccessible areas.

In the preferred embodiment, the handle or gripping member 34 is integrally molded of plastic or similar material with the base 32 to provide an extremely rigid and durable unitary item which is also economical to manufacture. More specifically, the gripping member 34 comprises a generally hollow tubular elongated portion defined by a flat top wall and a "D-shaped" side and bottom closure (FIG. 4). The tubular handle gripping member 34 may be open on its free end and provided with a plurality of grooves 60 which facilitate grasping by providing additional friction with the hand of the user. In addition, a plurality of finger ridges or other type of non-slip surfaces may be provided on the D-shaped lower side.

The tubular handle portion 34 is molded integrally at one end and secured to the top or apex of the base portion 32 as shown. Preferably, the contours are smooth and flowing to prevent crevices where paint particles may attach. An obtuse, generally cylindrical aperture 64 is provided at the connection between the handle portion 34 and the base portion 32 for use in mounting an extension pole 66 as shown in FIG. 4. A portion 68 of the wall which defines the cylindrical aperture 64 closes the inner end of the generally tubular handle portion 34, as shown in FIG. 2. The axis of the cylindrical aperture lies generally parallel to the forward facing wall of the base member 32, as best seen in FIGS. 2 and 4, to form an angle of approximately 40° with the surface of the paint applicator and handle 34.

The cylindrical aperture 64 extends inwardly past the rear base wall 44 and is open to the interior of the base 32. In the molding process, the juncture between the handle gripping portion 34 and the apex of the base 32 may be smoothed out or filled in to provide a more rigid connection between the base 32 and the handle portion 34 and also to facilitate cleaning of the tool as well as adding to the quality and appearance of the tool 10.

In the preferred embodiment, the handle portion 34 is secured to the base 32 so that it extends generally parallel to the painting surface 24 of the applicator pad 14. Referring to FIG. 3, this particular angular relationship beteen the handle 34 and the applicator pad 14 permits the user to easily paint those surfaces within arms length without requiring strenuous physical exertion or causing unnecessary fatigue. This short grippable handle portion 34 has been found to be very suitable and at the proper angle for painting nearby surfaces. However, it has been found that when it is desirable to paint more remote surfaces, such as the upper portions of walls and ceilings, it is necessary that the extension pole 66 be used.

In the past, as shown by the prior art patents, it was necessary to provide a hinge to the grippable handle portion 34 so that the angle between the paint applying surface 24 of the applicator element 14 could be adjusted relative to the grippable handle portion 34. This is necessary and desirable since the extension of the short handle 34 which is parallel to the painting surface 24 would be cumbersome and practically impossible to use for painting remote areas. It has also been found that when painting remote areas, the most useful and practical angle to be formed between the paint applying surface and an extension pole is generally an angle of approximately 40° to 45°, or, at least within that range. It has been found that a compromise angle between the parallel arrangement and the 45° is not suitable for painting remote areas with the use of an extension pole and is similarly very fatiguing to the hand when used without an extension pole.

The present invention, referring to FIGS. 2 and 4, provides for use of an extension pole 66 which is mounted by the obtuse cylindrical aperture 64. More particularly, the obtuse aperture 64 includes an internal thread 70 which is suitably threadably engaged by a complementary thread 72 on one end of the extension pole 66. Thus, when the painter desires to use the tool 10 for painting more remote areas, the extension pole 66 is easily attached by insertion into the cylindrical threaded aperture portion 64. This particular adaptation and use is shown more clearly in FIG. 4 where the paint applying tool 10 is connected to an extension pole 66 for holding by the hand of a user on its opposite end. Thus, more remote areas such as the top of a wall near the ceiling can be easily reached by the use of the extension pole 66.

The trim guide protuberances 56 are extremely helpful when the paint applying tool 10 is used with the extension pole 66. In addition, the present invention provides a much superior painting tool since the cross-sectional shape of the hand grippable portion 34 is not limited to a cylindrical configuration. Prior art devices required a cylindrical or substantially cylindrical handle so that the extension pole could be inserted for threading or other frictional securement. The D-shaped cross section of the handle 34 of the present invention is much superior in that it is more comfortable and less fatiguing for use in a hand held manner. In addition, the system for mounting the removable applicating pads 14 to the base 32 facilitates in the manufacture of the base plate 26 and flanges 28 and 30 thereof. Specifically, prior art tools of this general type required a reverse outwardly directed flange to be formed on either the front or rear flange 28 or 30 so that the tool base 32 could be "snap fit" between the flanges by manual pressure. The slide mounting and detent locking mechanisms shown in the drawings and described above eliminate the need for this additional flange portion and thus reduces the cost and time involved in the manufacture of the applicating pads.

It should be noted that any connection means between the extension pole 66 and the cylindrical aperture portion 64, other than the threaded attachment means shown, can be used without departing from the spirit and scope of the present invention. Similarly, the angles and descriptions with respect to the specific embodiment shown in the drawings and described hereinabove have been given for clearness of understanding only and no unnecessary limitations are to be understood therefrom as many modifications will be obvious to those skilled in the art, while such modifications will not depart from the spirit and scope of the invention defined in the claims.

I claim:

1. A paint applying tool comprising a base with forward, rear and opposite sides which define an elongated pyramid, an applicating pad connected to the base, and means secured to said base at the apex of said pyramid for manual gripping by the user, said manual gripping means including a relatively short stationary handle portion having a longitudinal axis and an external gripping surface, and connector means for releasably connecting an elongated handle to the base at an angle with respect to said stationary handle portion, said connector means comprising an internally threaded element on said base adapted to receive an elongated handle having an external thread on the end thereof wherein said internally threaded element comprises a cylindrical cavity having a longitudinal axis, said cavity being formed integrally with the base such that the axis of said cylindrical cavity forms an acute angle with respect to the axis of the stationary handle portion, said stationary handle portion being a hollow elongated tubular section secured to said base such that the axis thereof and the axis of said cylindrical cavity define a plane bisecting said base which is normal to the work surface of said paint applicating pad.

2. The paint applying tool of claim 1 wherein said elongated handle lies in a plane parallel to the forward said of said base.

3. The paint applying tool of claim 1 wherein said acute angle is at least 20°.

4. The paint applying tool of claim 1 wherein the angle formed between the stationary handle and the elongated handle is approximately 45°.

5. The paint applying tool of claims 1 or 4 wherein said stationary handle has a D-shaped cross section.

6. The paint applying tool of claim 1 wherein said rear side is generally normal to said applicator pad.

7. The paint applying tool of claims 1 or 6 wherein substantially the entire length of said stationary handle portion lies rearwardly of said rear side.

* * * * *